US006611180B1

(12) United States Patent
Puzella et al.

(10) Patent No.: US 6,611,180 B1
(45) Date of Patent: Aug. 26, 2003

(54) EMBEDDED PLANAR CIRCULATOR

(75) Inventors: Angelo Puzella, Marlboro, MA (US); Kenneth Komisarek, Acton, MA (US); Joseph Crowder, Marlborough, MA (US); Patricia Dupuis, Medway, MA (US); Gary Kingston, Taunton, MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/123,806

(22) Filed: Apr. 16, 2002

(51) Int. Cl.[7] ..... H01P 1/32
(52) U.S. Cl. ..... 333/1.1; 333/24.2
(58) Field of Search ..... 333/1.1, 24.2

(56) References Cited

U.S. PATENT DOCUMENTS

| | | | | |
|---|---|---|---|---|
| 4,704,588 A | * | 11/1987 | Kane | 333/1.1 |
| 5,940,031 A | | 8/1999 | Turlington et al. | 342/372 |
| 6,005,451 A | | 12/1999 | Wendel | 333/128 |
| 6,127,978 A | | 10/2000 | Uematsu et al. | 343/700 MS |
| 6,154,176 A | | 11/2000 | Fathy et al. | 343/700 MS |
| 2001/0017576 A1 | | 8/2001 | Kondo et al. | 333/24.2 |
| 2002/0135434 A1 | * | 9/2002 | Emanuelsson | 333/1.1 |

FOREIGN PATENT DOCUMENTS

| | | | | |
|---|---|---|---|---|
| JP | 09289403 A | * | 11/1997 | H01P/1/387 |

* cited by examiner

*Primary Examiner*—Terry D. Cunningham
*Assistant Examiner*—Quan Tra
(74) *Attorney, Agent, or Firm*—Daly, Crowley & Mofford, LLP

(57) ABSTRACT

A planar circulator assembly includes a dielectric substrate having a first surface and an opposing second surface, a plurality of circulator circuits, each circulator circuit having a first ferrite receiving pad disposed on the first surface and a second ferrite receiving pad; disposed on the second surface a first sub-assembly board disposed on the first surface having a plurality of first apertures, a plurality of ferrite-magnet sub-assemblies, each ferrite-magnet sub-assembly disposed in a corresponding first aperture and aligned with a corresponding first ferrite receiving pad and electromagnetically coupled to the corresponding first ferrite receiving pad. The assembly further includes a second sub-assembly board disposed on the second surface having a plurality of second apertures, and a plurality of ferrites, each ferrite disposed in a corresponding second aperture and aligned with a corresponding second ferrite receiving pad and electromagnetically coupled to the corresponding second ferrite receiving pad.

25 Claims, 8 Drawing Sheets

EMBEDDED PLANAR CIRCULATOR

CROSS-REFERENCE TO RELATED APPLICATIONS

Not applicable.

STATEMENTS REGARDING FEDERALLY SPONSORED RESEARCH

Not applicable.

FIELD OF THE INVENTION

This invention relates generally to communications systems and, more particularly, to planar circulators and methods of fabrication.

BACKGROUND OF THE INVENTION

As is known in the art, a radar or communications system antenna generally includes a feed circuit and at least one conductive member generally referred to as a reflector or radiator. As is also known, an array antenna can include a plurality of radio frequency (RF) circulators disposed in an array in a manner in which RF signals can be received from or transmitted to the same individual radiator. Sharing the radiators for both transmitting and receiving signals allows a reduction in the size of the antenna in applications where simultaneous transmission and reception is not required. The circulators are also referred to as transmit/receive (T/R) elements.

As is also known in the art, the radio frequency (RF) circulator is a three-port device, having a first, a second, and a third port. A conventional circulator provides a directional capability so that an RF signal applied as an input to the first port provides an output signal at only the second port. Similarly, an RF signal applied as an input to the second port provides an output signal at only the third port, and an RF signal applied as an input to the third port provides an output signal at only the first port.

Conventional circulators are typically provided as discrete devices that can be mounted to a circuit board. Since it contains discrete devices, the conventional circulator does not provide an optimal form factor for high density electronics packaging. In commercial applications, it is often desirable to integrate RF circuits into low profile, low cost packages. For example such devices would be desirable for commercial cell phones. In military surface and airborne applications, there is a need for tile arrays having multiple board layers. Further, in these applications there is a need for low profile, low cost arrays which often require a large number of circulators for corresponding radiators. In conventional systems the circulators are often individually packaged in the transmitter/receiver (T/R) modules thereby increasing module cost and increasing the unit cell footprint so as to reduce an array scan volume versus frequency characteristic due to interference from adjacent lobes in the antenna pattern.

One conventional method (referred to as the discrete method) includes steps for fabricating individual circulators having gaussed (i.e. magnetized) magnets and embedding each individual circulator in a dielectric or metal carrier. This method requires precise alignment and ribbon (or wire) bonding to complete the RF circuit. In addition, the gaussed magnets must be individually magnetized and are exposed to high lamination temperatures during fabrication. Consequently, the magnets experience partial de-magnetization causing a non-uniform magnetization adversely affecting circulator performance. This effect is a function of magnet location across the array. Embedding each individual circulator in a dielectric or metal carrier requires precise individual alignment between the circulator transmission line ports and the carrier transmission line ports. Ribbon (or wire) bonding between circulator transmission lines and board transmission lines to complete an RF circuit requires special plating (e.g., gold plating) for soldering or bonding. Consequently, the RF bandwidth is reduced and signal losses are increased due to process variations that add parasitic reactances to the RF transmission line.

It would, therefore, be desirable to eliminate the ribbon or wire bonding steps, and reduce the alignment tolerances and magnetize (gauss) the magnets after lamination and processing. It would be further desirable to reduce the antenna unit cell spacing by reducing the T/R module footprint to provide a larger scan volume. It would be further desirable to seal the circulators from the environment, and to produce planar assemblies with a plurality of circulators and to produce individual circulators in bulk at a low cost.

SUMMARY OF THE INVENTION

In accordance with the present invention, a planar circulator assembly includes a dielectric substrate having a first surface and an opposing second surface, a plurality of circulator circuits each having a first ferrite receiving pad disposed on the first surface and a second ferrite receiving pad disposed on the second surface a first sub-assembly board. The first sub-assembly board is disposed on the first surface, has a plurality of first apertures, a plurality of ferrite-magnet sub-assemblies, each ferrite-magnet sub-assembly disposed in a corresponding first aperture and aligned with a corresponding first ferrite receiving pad and electromagnetically coupled to the corresponding first ferrite receiving pad. The assembly further includes a second sub-assembly board disposed on the second surface having a plurality of second apertures, and a plurality of ferrites each disposed in a corresponding second aperture aligned with a corresponding second ferrite receiving pad and electromagnetically coupled to the corresponding second ferrite receiving pad.

This arrangement eliminates fabrication of individual circulators by embedding each individual circulator in a dielectric or metal carrier. Such an arrangement further eliminates precise alignment and ribbon (or wire) bonding for attaching circulators in fixed orientations to complete the RF circuit by using epoxies and/or solders. With such an arrangement, a plurality of low-profile circulators are embedded in a multi-layer laminate in one bonding step using standard Printed Wiring Board (PWB) and Surface Mount Technology (SMT) processes, for example this arrangement reduces the antenna unit cell spacing by reducing the T/R module footprint in order to provide a larger radar scan volume.

In accordance with a further aspect of the present invention, a planar circulator assembly includes at least one first RF port via disposed in the first sub-assembly board, each first RF port via having a first end coupled to a corresponding one of the first, second and third ports and a second end coupled to a connection disposed on a first outer surface of the circulator assembly. The planar circulator assembly further includes at least one second RF port via disposed in the second sub-assembly board, each second RF via having a first end coupled to one of the first, second and third ports and a second end coupled to a connection disposed on a second outer surface of the circulator assembly disposed opposite the first outer surface. With such an arrangement, the circulators can be bonded to seal the circulators from the environment.

In accordance with a further aspect of the present invention, a method for making an embedded planar circulator assembly includes providing a circulator board having a first surface and an opposing second surface, forming a plurality of circulator circuits disposed on the circulator board, each circuit having a ferrite receiving pad disposed on the first surface and a corresponding ferrite receiving pad on the second surface, providing a plurality of ferrite-magnet sub-assemblies disposed in a first sub-assembly. The method further includes providing a plurality of ferrites disposed in a second sub-assembly, and bonding the circulator board between the first sub-assembly and the second sub-assembly such that the ferrite-magnet sub-assemblies are urged against a corresponding ferrite receiving pad disposed on the first surface of the circulator board and the ferrites are urged against the corresponding ferrite receiving pad on the second surface of the circulator board. With such a technique, the ribbon or wire bonding steps are eliminated, alignment tolerances are reduced and the magnets can be magnetized after the lamination and processing steps.

In accordance with another aspect of the present invention, a method for making an embedded planar circulator assembly further includes separating the plurality of circulator circuits into a corresponding plurality of individual unit cells. With this technique, individual circulators can be produced in bulk in a low profile package and at a low cost.

The relatively high cost of phased arrays has precluded the use of phased arrays in all but the most specialized applications. Assembly and component costs (especially the active transmit/receive module including circulators) are major cost drivers. Phased array costs can be reduced by leveraging batch processing and minimizing touch labor of components and assemblies. In one embodiment, the circulators which are typically discrete components wired into T/R modules, are embedded in Polytetrafluoroethylene (PTFE) dielectric laminates, thus reducing cost and complexity in the T/R modules. In addition, the size of the unit cell of a phased array is reduced by including the array of circulators in a single planar assembly. The embedded planar circulator is fabricated with high temperature bonding adhesives common to the PWB industry and the circulator magnets are conveniently magnetized after bonding. The result is a compact, sealed, low cost and high performance array of circulators in a planar array arrangement. Individual circulators are produced in volume by spacing a plurality of circulators on a single circulator board to facilitate separation into individual unit cells.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Before describing the radar system of the present invention, it should be noted that reference is sometimes made herein to a circulator board having a particular array shape. One of ordinary skill in the art will appreciate of course that the techniques described herein are applicable to various sizes and shapes of circulator boards. It should thus be noted that although the description provided herein below describes the inventive concepts in the context of a rectangular unit cell, those of ordinary skill in the art will appreciate that the concepts equally apply to other sizes and shapes of array antennas having corresponding circulator board arrays arrangements including, but not limited to, rectangular, circular, and other arbitrary lattice geometries such as square, equilateral, isosceles triangle, and spiral geometries. Each embedded circulator occupies a portion of the unit cell area for each antenna element. The inventive embedded planar circulator approach is applicable to linear or circularly polarized phased arrays for military or commercial wireless applications.

Reference is also sometimes made herein to the array antenna including a radiating element of a particular type, size and shape. For example, one type of radiating element is a so-called patch antenna element having a square shape and a size compatible with operation at a particular frequency (e.g. 10 GHz). Those of ordinary skill in the art will recognize, of course that other shapes and types of antenna elements may also be used and that the size of one or more radiating elements may be selected for operation at any frequency in the RF frequency range (e.g. any frequency in the range of about 1 GHz to about 100 GHz). The types of radiating elements which may be used in the antenna of the present invention include but are not limited to notch elements, dipoles, slots or any other radiating element known to those of ordinary skill in the art which can be coupled to a circulator.

Figure 1:
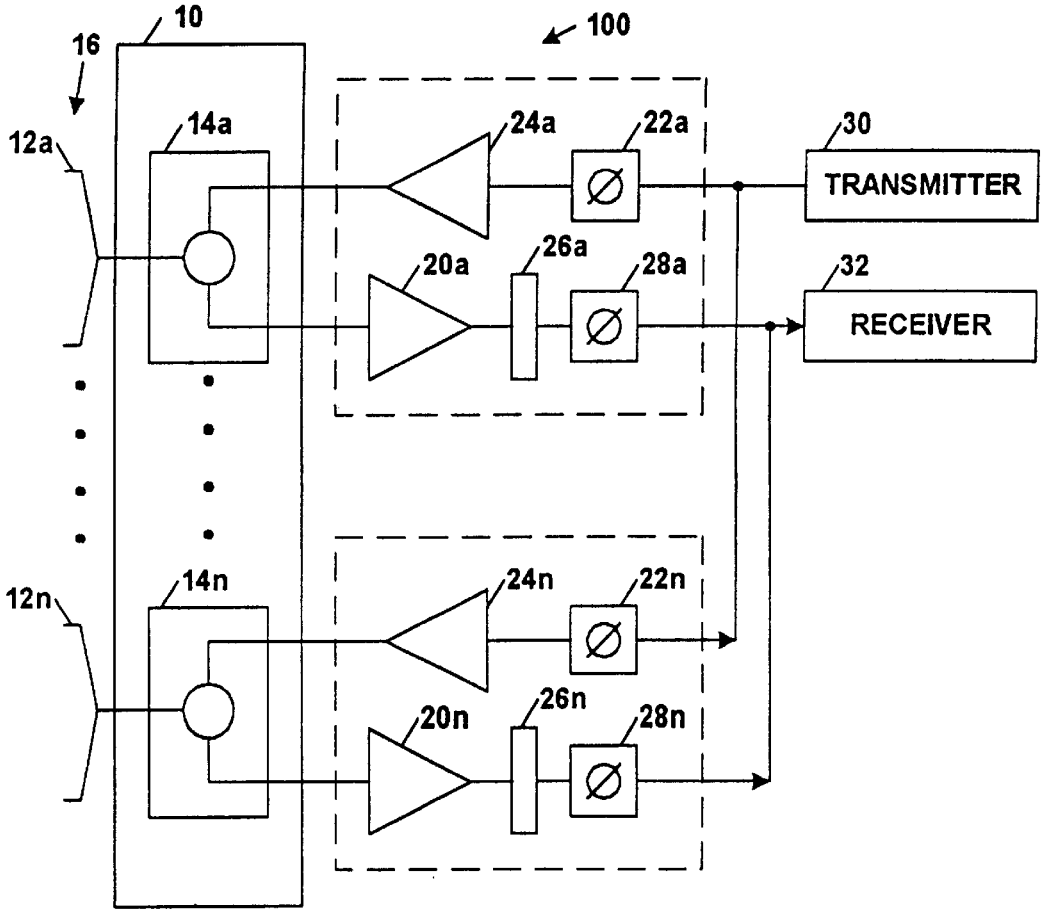
FIG. 1 is a block diagram of a radar or communications system including an embedded planar circulator assembly in accordance with the present invention.

Referring now to FIG. 1, an exemplary embodiment of a radar or communications system 100 including an embedded planar circulator assembly 10 in accordance with the present invention for transmitting and receiving signals is shown. The radar or communication system 100 includes an antenna array 16 having a plurality of radiating elements 12*a*–12*n* (generally referred to as radiating elements 12). The embedded planar circulator assembly 10 includes a plurality of transmit/receive (T/R) modules 14*a*–14*n* (generally referred to as T/R modules 14). The radiating elements 12 are coupled to corresponding T/R modules 14*a*–14*n*, each of which is coupled to a plurality of amplifiers 24*a*–24*n* and a plurality of phase shifters 22*a*–22*n* in the transmit path and a plurality of amplifiers 20*a*–20*n*, a plurality of attenuators 26*a*–26*n* and a plurality of phase shifters 28*a*–28*n* in the receive path, respectively. In a radar system the T/R modules 14 can be shared by the radiating elements of both a sum channel beamformer (not shown) and a difference channel beamformer (not shown), for example.

Now referring to FIG; 2, an embedded planar circulator assembly 10 includes an upper board sub-assembly 40 disposed on a circulator circuit board 42, which is disposed on a lower board sub-assembly 44. The upper board sub-assembly 40 includes a plurality of recessed two-step cavities 46 adapted to receive a plurality of ferrite-magnet sub-assemblies 48, which includes a magnet 50 disposed on a ferrite 52.

The upper board sub-assembly 40 further includes a plurality of antenna port vias 62 adapted to connect to a plurality of radiators (not shown). The circulator circuit board 42 comprises a plurality of circulator board unit cells 54*a*–54*n* (generally referred to as unit cells 54), which are coupled to the plurality of antenna port vias 62 and to the plurality of ferrite-magnet sub-assemblies. The lower board sub-assembly 44 includes a plurality of recessed cavities 58 adapted to receive a plurality of ferrite-pole piece assemblies 59. The plurality of ferrite-pole piece assemblies 59 include a plurality of ferrites 56 disposed on a corresponding plurality of pole pieces 57, here for example steel pole pieces 57 which have approximately the same diameter of the ferrite 56 and are bonded to each of the ferrites 56. The lower board sub-assembly 44 further includes a plurality of receive port vias 64 and transmit port vias 66 which are adapted to couple receive and transmit feed circuits (not shown) to respective ports on the plurality of circulator board unit cells 54. It will be appreciated by those of ordinary skill in the art that that the lower ferrite 56 and pole piece 57 forming ferrite-pole piece assemblies 59 can be replaced with a ferrite-pole piece-magnet assembly, and that pole pieces (not shown) can be added to the upper ferrite-magnet sub-assemblies 48 for improved bandwidth and lower loss.

In one particular embodiment, the circulator circuits include etched copper circuits on both sides of a copper clad PTFE (Polytetrafluoroethylene) substrate, for example Rogers 3010 (a high frequency circuit material manufactured by Rogers corporation), and the upper and lower upper board sub-assembly 40 and 44 are fabricated from PTFE. In another embodiment the ferrite 52 material is includes Garnet and the magnet 50 material includes Samarium Cobalt (SmCo). The magnets 50 provide a static (DC) magnetic field to each circulator board unit cell 54 to induce circulator action. Other exemplary materials and properties used in the alternate embodiments of the embedded planar circulator assembly 10 are listed in Table 1:

TABLE 1

Embedded Planar Circulator Materials

| Description | Material Property | Exemplary Material |
|---|---|---|
| Thermoplastic Adhesive | $\epsilon_r$ = 2.32; tan$\delta$ = .0013 | Arlon CuClad 6250 |
| Circuit Carrier | $\epsilon_r$ = 10.2; tan$\delta$ = .0035 | Rogers 3010 |
| Upper & Lower Board Substrate (40, 44) | $\epsilon_r$ = 10.2; tan$\delta$ = .0035 | Rogers 3010 |

TABLE 1-continued

Embedded Planar Circulator Materials

| Description | Material Property | Exemplary Material |
|---|---|---|
| Ferrite (52, 56) | $\epsilon_r$ = 15.8; tan$\delta$ = 0.0002; $\sigma$ = 0.01 S/m $4\pi$Ms = 1780; $\Delta$H = 45 Oersteds; Lande g = 2 | Garnet Ferrite Material |
| Magnet (50) | Hdc = 40 kA/m | Samarium-Cobalt magnet |
| Pole Piece (57) | | 410 Steel |

Where $\epsilon_6$ is the dielectric constant;

tan $\delta$ is the loss tangent of the material;

Hdc is the static (DC) magnetic field; and

410 Steel is a typical steel material used to provide pole pieces.

Figure 3A:
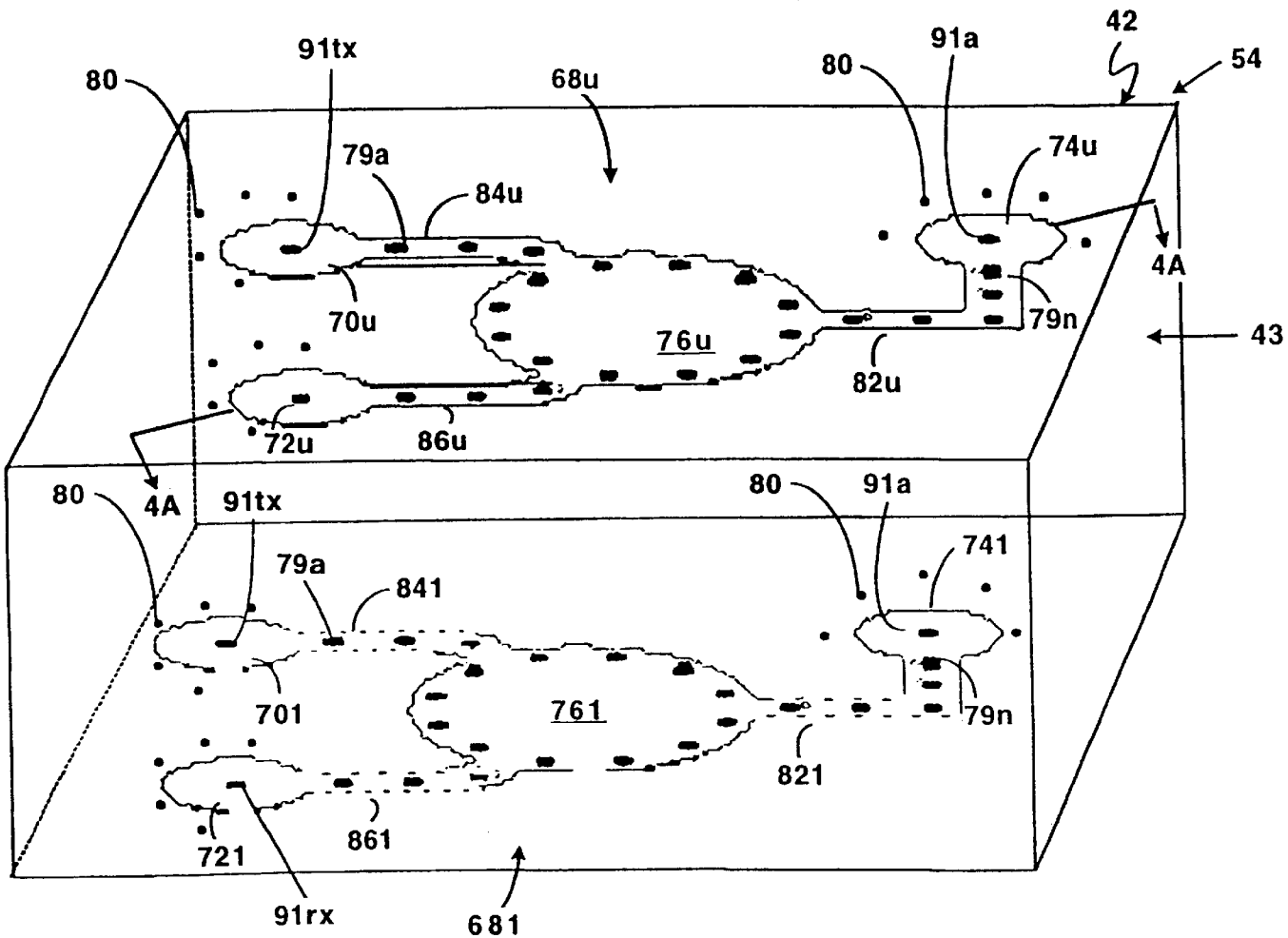
FIG. 3A is an isometric view of a circulator circuit board unit cell of the embedded planar circulator assembly of FIG. 2.

Now referring to FIG. 3A, a circulator board unit cell 54 includes an upper surface circuit portion 68*u* and a corresponding lower surface circuit portion 681 separated by an insulating dielectric 43 of the circulator board 42. The upper surface circuit portion 68*u* includes a first port portion 70*u* coupled to an upper circulator junction 76*u* (also referred to as upper ferrite receiving pad) by a stripline circuit 84*u*. The upper circulator junction 76*u* is coupled to a second port portion 72*u* by a stripline circuit 86*u* and to a third port portion 74*u* by a further stripline circuit 82*u*. The first port portion 70*u* includes a connection $\mathbf{91}_{TX}$, the second port portion 72*u* includes a connection $\mathbf{91}_{RX}$, and the third port portion 74*u* includes a connection $\mathbf{91}_{A}$.

The lower surface circuit portion 681 includes a first port portion 701 coupled to a lower circulator junction 761 (also referred to as lower ferrite receiving pad 761) by a stripline circuit 841. The lower circulator junction 761 is coupled to a second port portion 721 by a stripline circuit 861 and to a third port portion 741 by a further stripline circuit 821. The first port portion 701 includes a connection $\mathbf{91}_{TX}$, the second port portion 721 includes a connection $\mathbf{91}_{RX}$, and the third port portion 741 includes a connection $\mathbf{91}_{A}$. The connections $\mathbf{91}_{RX}$, $\mathbf{91}_{TX}$, $\mathbf{91}_{A}$ are coupled to plated RF vias $\mathbf{90}_{RX}$, $\mathbf{90}_{TX}$ and $\mathbf{90}_{A}$ when these vias are fabricated. The upper and lower surface circuits 68*u*, 681 and the upper and lower circulator junctions 761, 76*u* include a plurality of interconnecting via connections 79*a*–79*n* (generally referred to as interconnecting via connections 79).

Figure 3B:
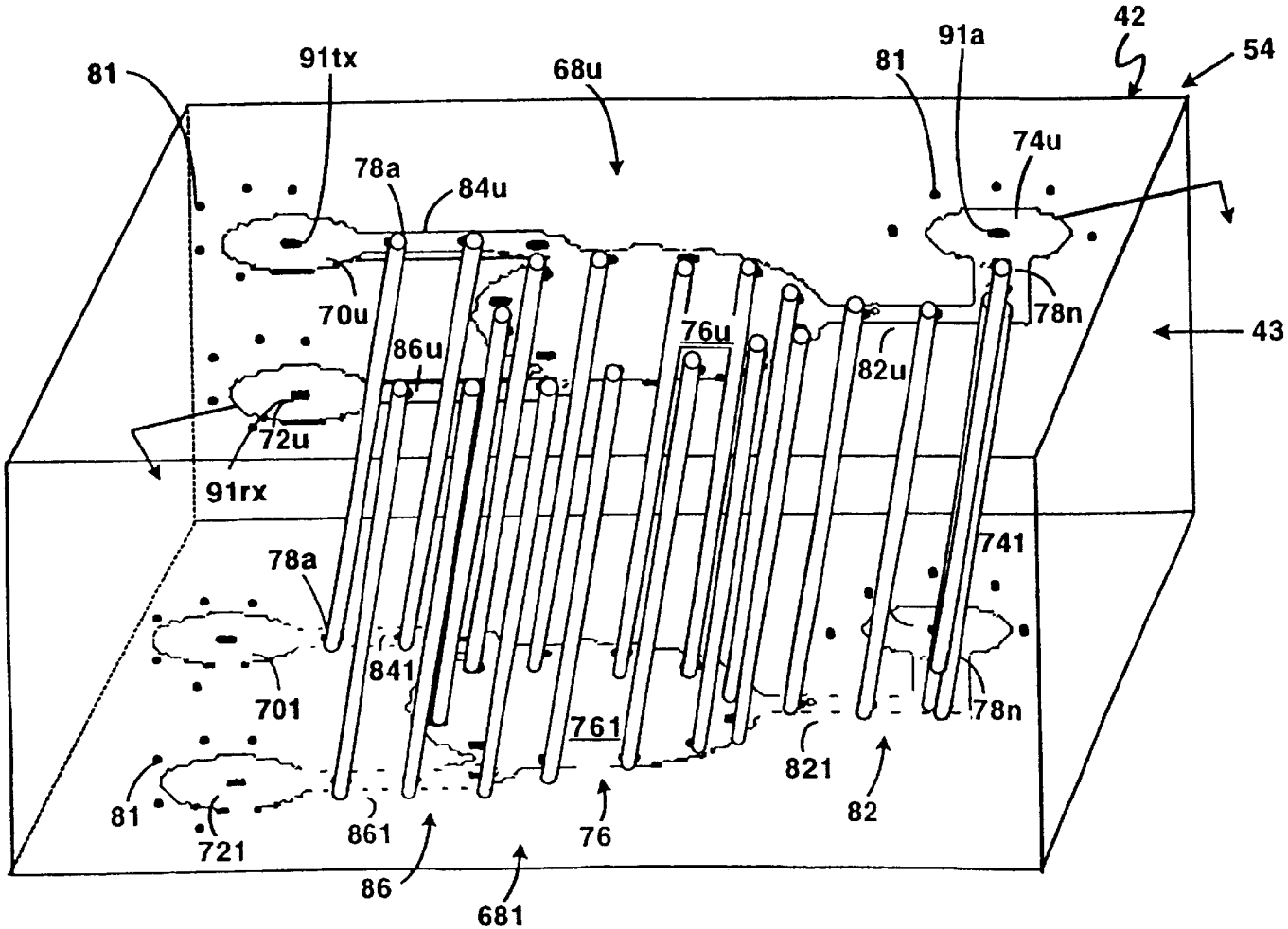
FIG. 3B is an isometric view of the unit cell of FIG. 3A including interconnecting vias.

Now referring to FIG. 3B showing different elements of the circulator board unit cell 54 of FIG. 3A which are shown separately for clarity, a plurality of plated interconnecting vias 78*a*–78*n* connect the stripline circuits 82*u*, 84*u*, and 86*u* on the upper surface circuit 68*u* to corresponding circuit elements on the lower surface circuit 681. For clarity, not all of the plated interconnecting vias 78*a*–78*n* are shown. The plated interconnecting vias 78*a*–78*n* are coupled to the plurality of interconnecting via connections 79. Thus, the upper and lower surface circuits 68*u*, 681 are electrically interconnected with the plated interconnecting vias 78 forming an equivalent "thicker" RF circuit for each of the unit cells 54. The thicker RF circuits are referred to as transmission lines 82, 84 and 86 which are connected to the interconnected circulator junction 76*u* and 761 referred to as the circulator junction 76 or the ferrite receiving pad 76. The plated interconnecting vias 78*a*–78*n* are formed during fabrication of the circulator board 42 (described below in further detail in conjunction with step 202 of FIG. 7). The upper and lower surface circuits 68*u*, 681 include a plurality of mode suppression post connections 81.

Figure 3C:
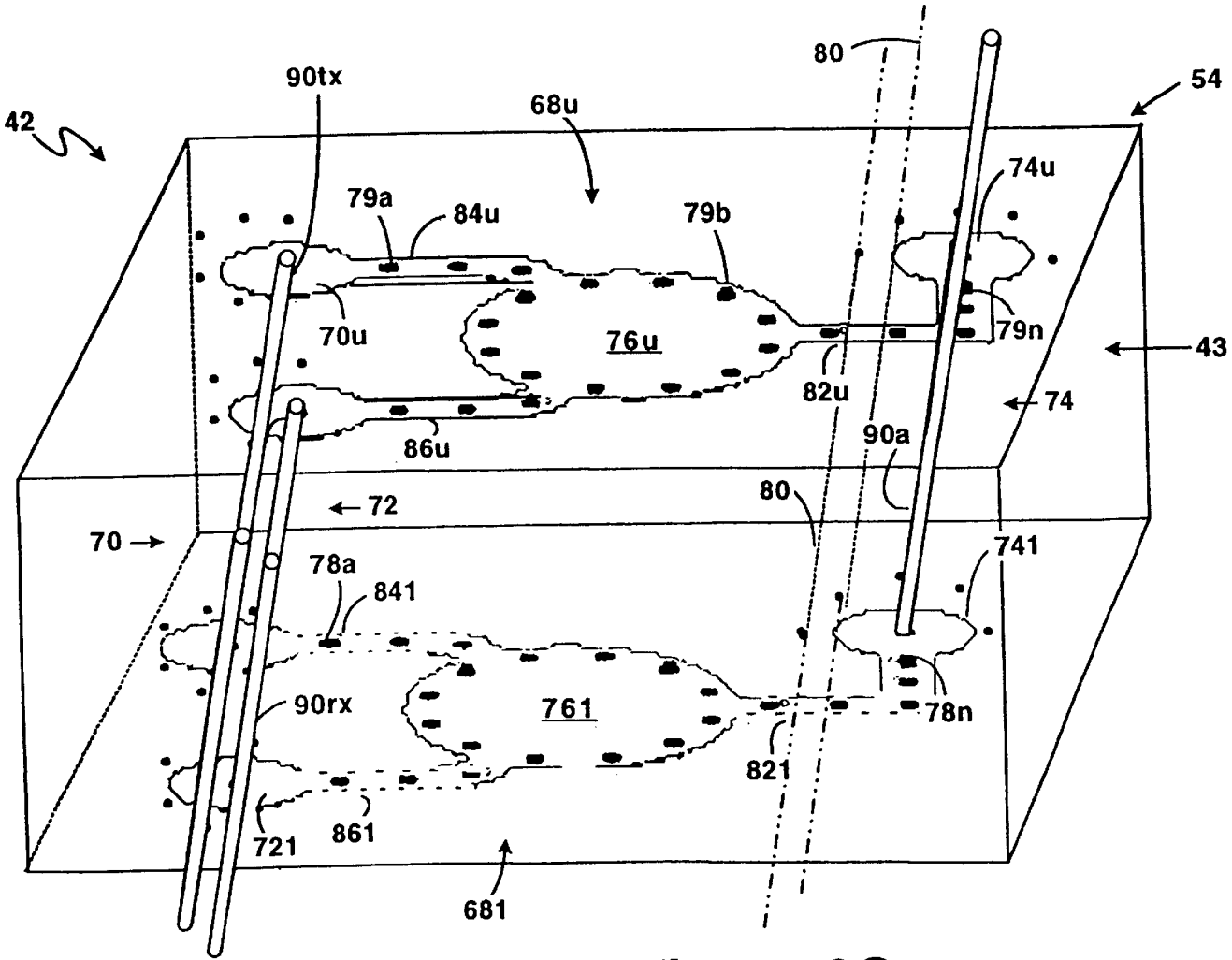
FIG. 3C is an isometric view of the unit cell of FIG. 3A including mode suppression posts and transmit, receive and antenna RF vias.

Now referring to FIG. 3C showing different elements of the circulator board unit cell 54 of FIG. 3A which are shown separately for clarity, a plurality of mode suppression posts 80 are disposed between the upper surface circuit portion 68*u* and the lower surface circuit portion 681. For clarity, not all of the plurality of mode suppression posts 80 are shown. The RF circuit further includes a receive port RF via $\mathbf{90}_{RX}$, an antenna port RF via $\mathbf{90}_{A}$, and a transmit port RF via $\mathbf{90}_{TX}$ (the three vias are generally referred to as RF vias 90) for each unit cell 54. FIG. 3C is shown for clarity without the plurality of plated interconnecting vias 78*a*–78*n* of FIG. 3B. Thus the upper and lower surface circuits 68*u* and 681 are electrically interconnected with the plated RF vias $\mathbf{90}_{RX}$, $\mathbf{90}_{TX}$ and $\mathbf{90}_{A}$ forming an equivalent "thicker" RF circuit for each of the unit cells 54 and, in particular, form a first port 70, second port 72 and third port 74 connected to the circulator junction 76 (ferrite receiving pad 76) through transmission lines 82–86. In one embodiment the first port 70 is a transmit port, the second port 72 is a receive port, and the third port 74 is an antenna port. It will be appreciated by those of ordinary skill in the art that an embedded planar isolator can be provided by terminating either the transmit RF port via $\mathbf{90}_{TX}$ or the receive RF port via $\mathbf{90}_{RX}$ in a resistive load. The RF vias 90 are disposed in the upper board sub-assembly 40,the circulator circuit board 42 and the lower board sub-assembly 44. For clarity, the RF vias $\mathbf{90}_{A}$, $\mathbf{90}_{RX}$, $\mathbf{90}_{TX}$ are not shown being terminated in connections on the outer surfaces of the upper board sub-assembly 40,and the lower board sub-assembly 44 respectively.

The circulator board 42 includes a plurality of mode suppression posts 80 (FIG. 3C) having first ends, for example, disposed in a circular pattern partially surrounding circuit portions 70*u*, 72*u*, 74*u*, and having second ends disposed in a circular pattern partially surrounding circuit portions 701, 721, 741. The mode suppression posts 80 include plated vias coupled to ground planes 98, 99 (FIG. 4) to provide pseudo-coaxial RF transmission lines in combination with the corresponding port vias 90 for each RF port. For clarity, the mode suppression posts 80 are not shown being coupled to ground planes 98, 99. The RF vias 90 and mode suppression posts 80 are formed after the sub-assemblies have been bonded (described below in further detail in conjunction with steps 222–228).

In one particular embodiment, the upper surface circuit 68*u* and the corresponding lower surface circuit 681 are etched copper circuits, the circulator board 42 is about 0.005 inches thick, the connections 79, 81, $\mathbf{91}_{RX}$, $\mathbf{91}_{TX}$, $\mathbf{91}_{A}$ are plated-thru holes, and the ferrite receiving pad 76 has a diameter of about 0.2 inches.

Figure 4:
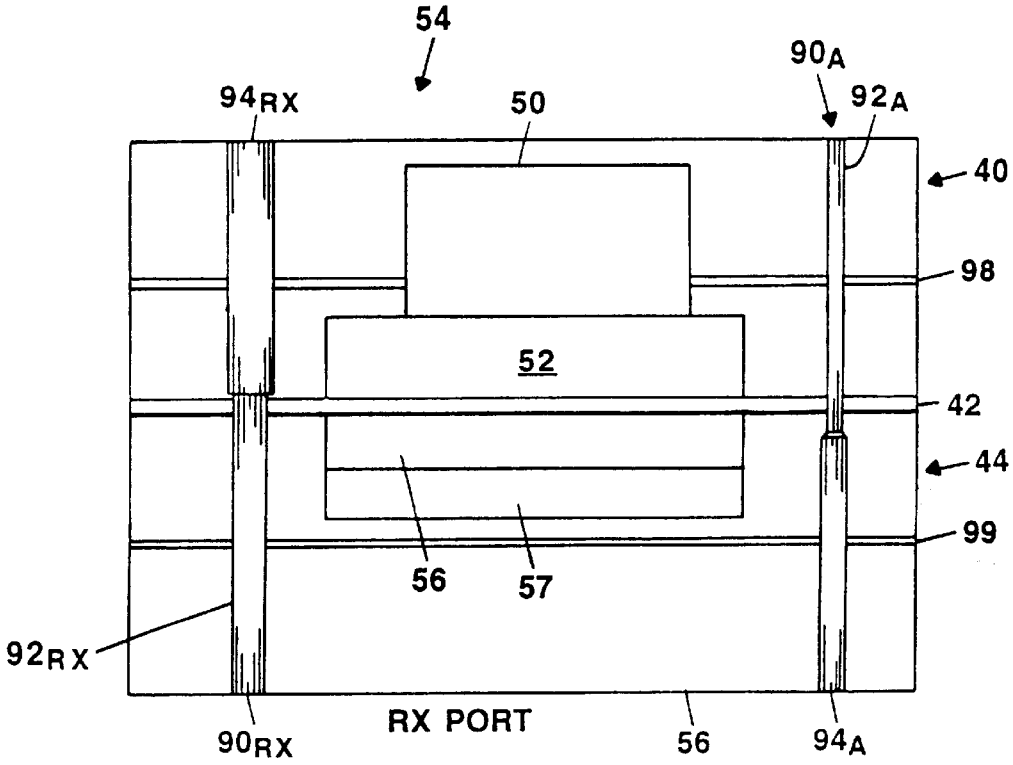
FIG. 4 is a cross-sectional view of the embedded planar circulator assembly of FIG. 1 and circulator circuit of FIG. 3 taken across line 4—4 in FIG. 3.

Now referring to FIG. 4, in which like reference numbers refer to like elements in FIG. 3, a cross section of FIG. 3A being taken along line 4—4 including the upper board sub-assembly 40 and the lower board sub-assembly 44 (FIG.2) is shown. An individual circulator unit cell 54 includes a magnet 50 disposed on a ferrite 52, which is disposed on a circulator circuit board 42. The unit cell 54 includes a pseudo-coaxial transmission line formed by antenna port 74*u* and 741 (FIG. 3C), plated interconnecting vias 78*a*–78*n*, mode suppression posts 80 and RF via $\mathbf{90}_{A}$ which are coupled to the circulator junction 76 (FIG. 3B) by the stripline circuit 82 (FIG. 3C), a receive port 72 RF via 90RX which is coupled to the circulator junction 76 by the stripline circuit 86 (FIG. 3A), and a transmit port RF via (not shown). The antenna port RF via $\mathbf{90}_{A}$ includes a plated portion $\mathbf{92}_{A}$ in the upper board sub-assembly 40 and a counter-drilled portion $\mathbf{94}_{A}$ in the lower board sub-assembly 44. The receive port RF via $\mathbf{90}_{RX}$ includes a plated portion $\mathbf{92}_{RX}$ in the lower board sub-assembly 44 and a counter-drilled portion $\mathbf{94}_{RX}$ in the upper board sub-assembly 40. The upper board sub-assembly 40 includes a ground plane 98 and the lower board sub-assembly 44 includes a further ground plane 99. The ground planes 98, 99 complete the stripline circuit formed by the upper surface circuit portion 68u and the lower surface circuit portion 681. The transmit port RF via includes a plated portion (not shown) in the lower board sub-assembly 44 and a counter-drilled portion (not shown) in the upper board sub-assembly 40.

In operation, received signals are coupled from an antenna radiator (not shown) through the antenna port RF via $\mathbf{90}_{A}$ through the stripline circuit 82 to the circulator junction 76 where the signals controlled by known circulator action are directed to the receive port RF via $\mathbf{90}_{RX}$ through the stripline circuit 86. The receive port RF via $\mathbf{90}_{RX}$ couples received signals to the receiver circuitry (not shown). Transmitted signals are coupled from the transmitter circuitry (not shown) to the transmit port RF via through the stripline circuit 84 to the circulator junction 76 where the signals controlled by known circulator action are directed through the stripline circuit 82 to the antenna port RF via $\mathbf{90}_{A}$ which is coupled to the antenna radiator (not shown).

Figure 4A:
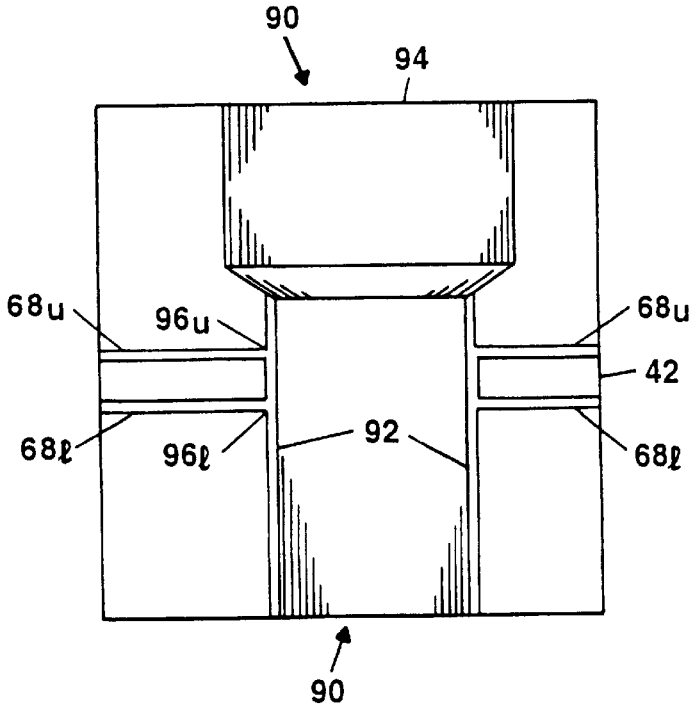
FIG. 4A is a more detailed cross-sectional view of a counter drilled via of FIG. 4.

Now referring to FIG. 4A, in which like reference numbers refer to like elements in FIG. 4, an RF via 90 (which here represents either the receive or transmit RF via) includes a plated portion 92 substantially disposed in the lower board sub-assembly 44 and a counter-drilled portion 94. An upper interconnection 96*u* with the upper surface circuit portion 68*u* and a lower interconnection 96lower with the lower surface stripline circuit 681 is formed when the via 90 is drilled out and plated. In a subsequent operation, the RF via 90 is counter drilled to remove the plating in the counter-drilled portion 94 to eliminate any unwanted RF effects. It will be appreciated that antenna RF via plated portion $\mathbf{92}_{A}$ is substantially disposed in the upper board sub-assembly 40 and FIG. 4A would be rotated 180 degrees to illustrate RF via plated portion $\mathbf{92}_{A}$.

Figure 2:
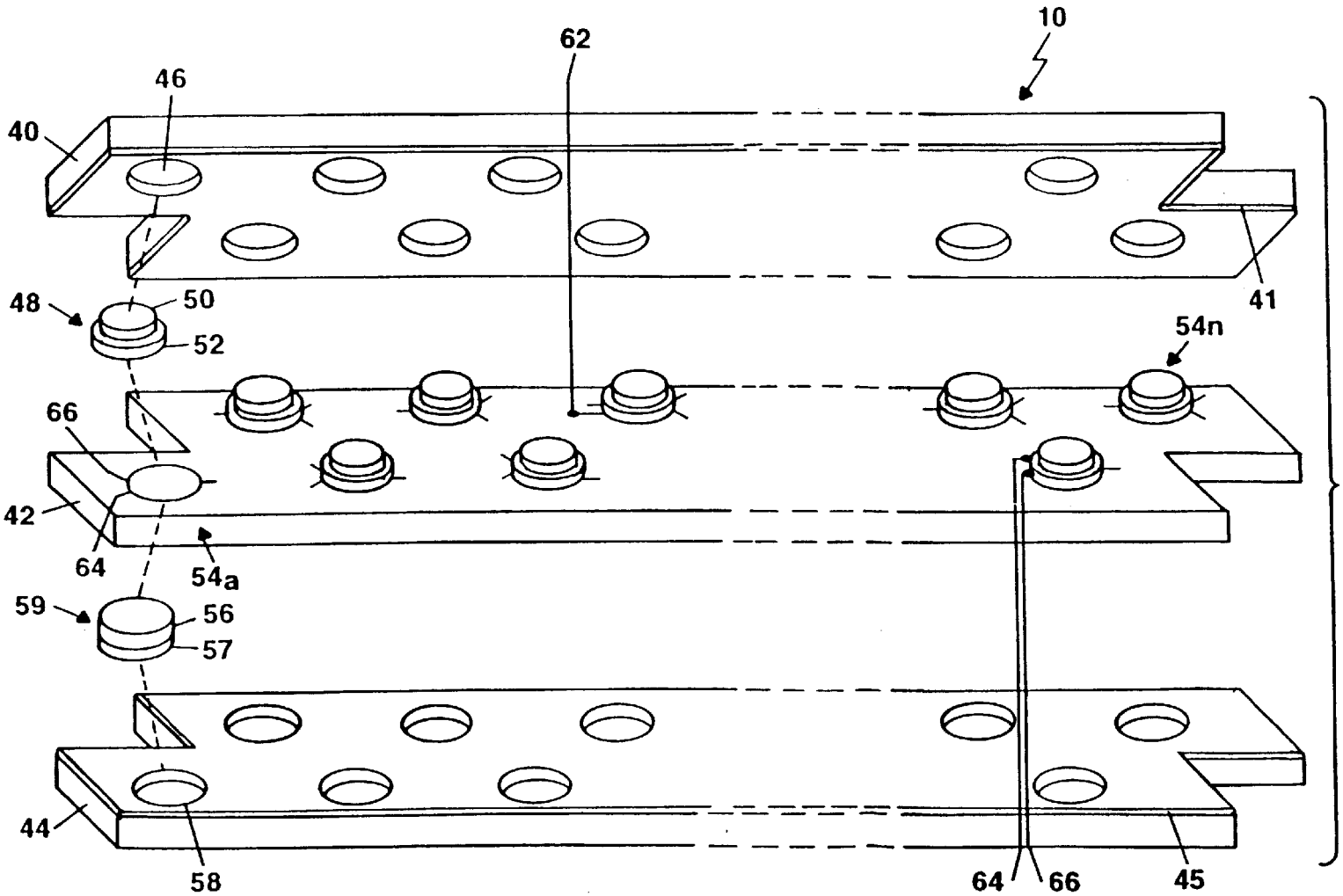
FIG. 2 is an exploded perspective view of the embedded planar circulator assembly of FIG. 1.
Figure 5:
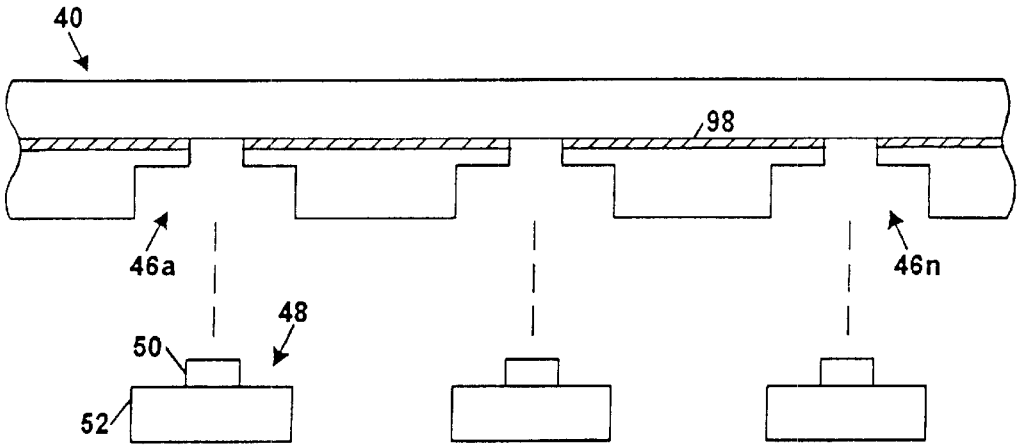
FIG. 5 is an exploded cross-sectional view of the upper encapsulating sub-assembly of the embedded planar circulator assembly of FIG. 1.

Now referring to FIG. 5, in which like reference numbers refer to like elements in FIG. 2, before bonding, an upper board sub-assembly 40 includes the plurality of cavities 46*a*–46*n* into which the plurality of ferrite-magnet sub-assemblies 48 are press fit. Before the lower board sub-assembly 44, the upper board sub-assembly 40 and circulator circuit board 42 are bonded together, the ferrite-magnet sub-assemblies 48 stand proud (i.e. are taller than the cavities 46) of the upper board sub-assembly 40. After bonding under temperature and pressure, the ferrite-magnet sub-assemblies 48 are urged into contact with the circulator junction 76.

Figure 6:
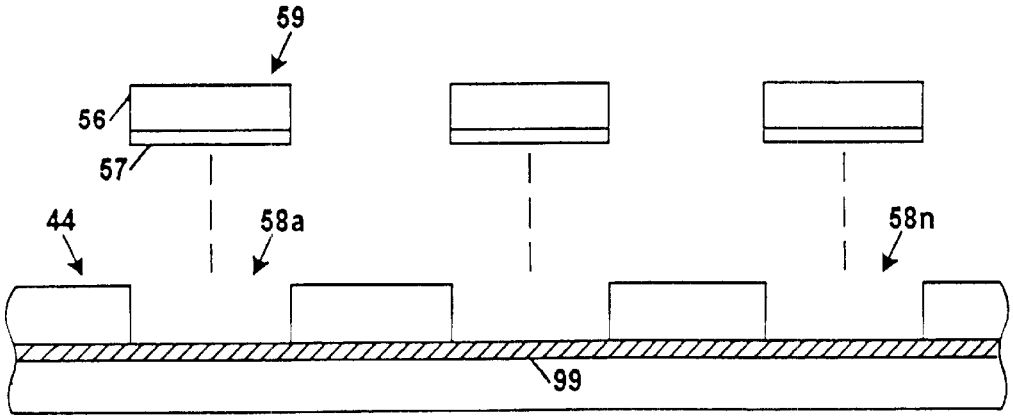
FIG. 6 is an exploded cross-sectional view of the lower encapsulating sub-assembly of the embedded planar circulator assembly of FIG. 1.

Now referring to FIG. 6 in which like reference numbers refer to like elements in FIG. 2, before bonding, a lower board sub-assembly 44 includes the plurality of cavities 58*a*–58*n* into which the plurality of ferrite-pole piece assemblies 59 (FIG. 2) are press fit. Before the lower board sub-assembly 44 upper board sub-assembly 40 and circulator circuit board 42 are bonded together, the ferrite-pole piece assemblies 59 stand proud (i.e. are taller than the cavity 58) of the lower board sub-assembly 44. After bonding under temperature and pressure, the ferrites 56 are urged into contact with the ferrite receiving pad 76.

Figure 7:
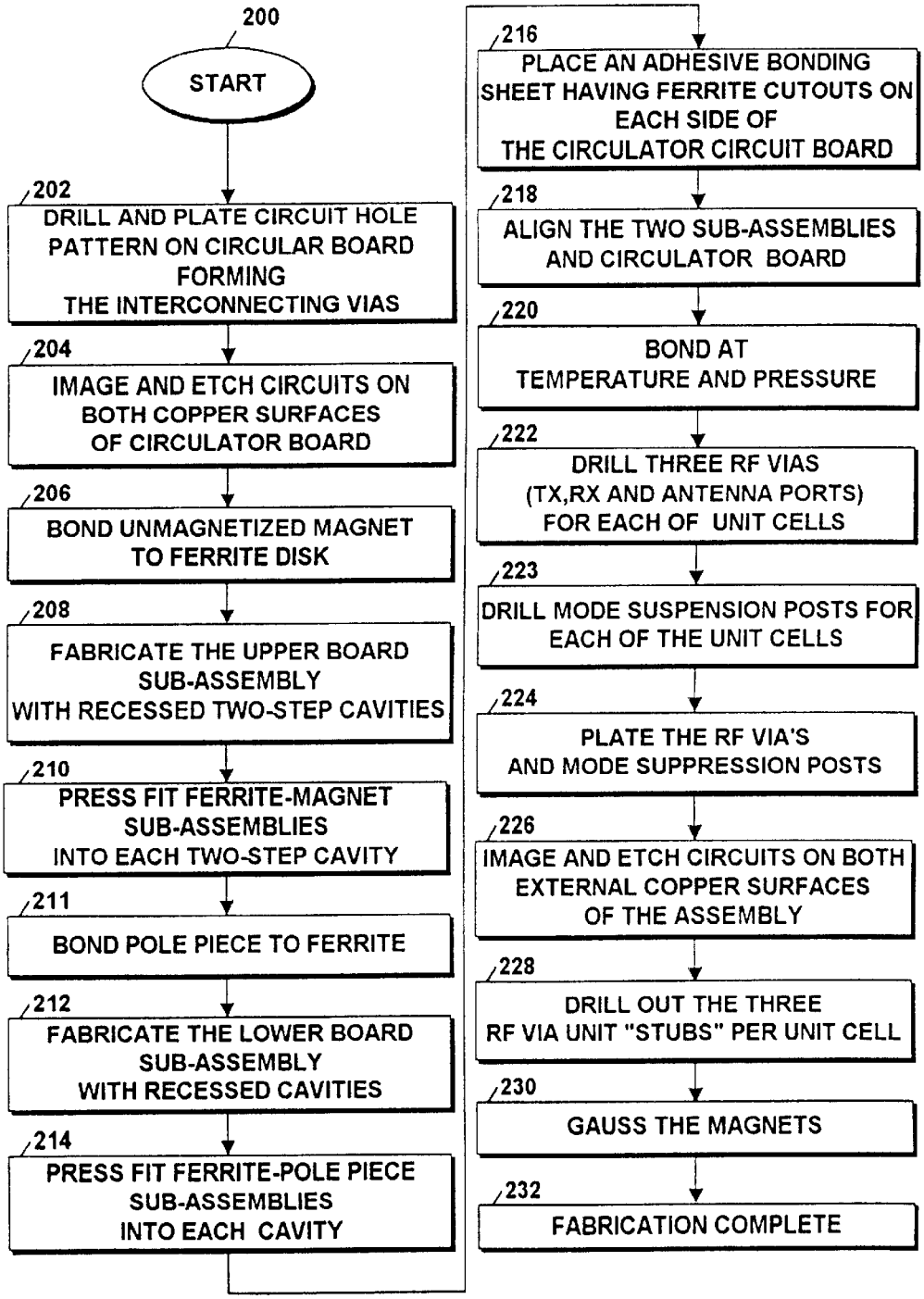
FIG. 7 is a flow diagram illustrating the steps to fabricate the embedded planar circulator of FIG. 1.

Now referring to FIG. 7, a flow diagram illustrates exemplary steps to fabricate the embedded planar circulator assembly 10 of FIG. 1. The procedure starts at step 200, then at step 202 interconnecting vias 78*a*–78*n* (FIG. 3) on circulator board 42 are drilled and plated. In one example, the circulator board is a 5-mil PTFE substrate and circuit etch tolerances of ±0.5-mils (typically associated with 0.5-oz. copper plating) are used.

At step 204, the upper surface circuit portion 68*u* (FIG. 3) and lower surface circuit 681 are imaged and etched on the circulator board 42 using known PWB techniques. The two circuit portions 68*u*, 681 are electrically connected by plated interconnecting vias 78*a*–78*n* that were formed in step 202.

At step 206, the ferrite-magnet sub-assemblies 48 are fabricated by bonding the magnets 50 onto ferrites 52. In one embodiment, the magnets 50 and the ferrites 52 are soldered together using a high temperature solder. The magnets 50 do not have to be magnetized at this step in the process.

At step 208, the upper board sub-assembly 40 is fabricated using layers of PTFE material with cutouts in at least two layers in order to form the recessed two-step cavities 46 adapted to receive a plurality of ferrite-magnet sub-assemblies 48. At step 210, the ferrite-magnet sub-assemblies 48 are press fit into the recessed two-step cavities 46 in order to securely retain the assemblies 48 until the bonding step 220. In one embodiment, the assemblies 48 are press fit using pick and place assembly techniques. The two-step cavity 46 has a diameter and depth such that the ferrite-magnet sub-assembly fits securely and also stands proud of the cavity 46 in order to assure a reliable contact between the ferrite-magnet sub-assembly 48 and the ferrite receiving pad 76 after the planar circulator assembly 10 is bonded at step 220.

At step 211, the pole pieces 57 are bonded to the ferrites 56 to provide the ferrite-pole piece assembly 59 (FIG. 2), for example, by using a high temperature solder.

At step 212, the lower board sub-assembly 44 is fabricated using layers of PTFE material with cutouts in at least one layer in order to form the recessed cavities 58 adapted to receive a plurality of ferrite-pole piece assemblies 59. In one embodiment the lower board sub-assembly is fabricated with recessed two-step cavity for an optional additional magnet.

At step 214 the ferrite-pole piece assemblies 59 are press fit into the recessed cavities 58 in order to securely retain the ferrite-pole piece assemblies 59 until the bonding step 220. In one embodiment, the ferrite-pole piece assemblies 59 are press fit using pick and place assembly techniques. In an alternate embodiment, an additional magnet (not shown) is bonded to the ferrite-pole piece assembly 59 for improved bandwidth and lower loss for high performance applications. To accommodate the additional magnet, the lower board assembly 44 includes a recessed two-step cavity (not shown).

At step 216, upper and lower adhesive bonding sheets 41 and 45 having cutouts aligned with ferrite-magnet sub-assemblies 48 and the ferrite-pole piece assemblies 59 respectively are placed on each side of the circulator board 42. In one embodiment, the adhesive bonding sheets 41 and 45 comprise a thermoplastic material such as fluorinated ethylene propylene (FEP). Other materials widely used in the PWB industry, including but not limited to, thermoset materials such as Speedboard-C™ (manufactured by W. L. Gore & Associates, Inc.) can be used to provide the bonding sheets 41 and 45. The adhesive bonding sheets 41 and 45 are pre-drilled to allow direct contact between the ferrite disks and the ferrite-magnet sub-assemblies 48 with the circulator junctions in order to reduce RF signal loss.

At step 218, the two sub-assemblies 40 and 42 are aligned with the circulator board 42. In one embodiment, alignment pins are used.

At step 220, the embedded planar circulator assembly 10 is bonded under temperature and pressure. The lamination cycle parameters range in temperature from about 250° F. to about 650° F. and in pressures from about 100 psi to about 300 psi depending on the particular materials used. High temperature thermoplastic adhesives are used in this step in order to provide flexibility in fabricating multi-layer strip-line circuit assemblies. Multi-layer Printed Circuit Boards with complex architecture are often fabricated using sequential laminations. This technique requires creating sub-assemblies with multiple laminations, done in sequence, starting with the highest temperature bonding materials. The succeeding laminations are done at progressively lower temperatures to prevent the re-melting of the previously created bond lines. Exemplary materials used for the lamination of one layer to another include a thermoplastic and a thermoset material. Thermoset materials, once they have been cured, will not soften or re-melt, and so they are may be a preferred choice for the first lamination in a sequential lamination process. Thermoplastic materials will soften each time they reach their melt temperature. Therefore, when using thermoplastic materials, that the melt temperature in subsequent fabrication steps should be kept below the melt temperature of the previously applied thermoplastic materials. In one embodiment, for example, 875 circulators are formed and embedded using a 18"×24" sheet of Rogers 3010 with a triangular lattice arrangement of each unit cell spaced 0.590" and 0.680" from adjacent unit cell 54 (for X-Band applications) in a single bonding operation. It will be appreciated by those of ordinary skill in the art that the planar circulator design is practical over a range including the S Band through the Ka-Band. In one embodiment, the three sub-assemblies 40, 42 and 44 include tooling holes (not shown) located outside the circuit area which are used to hold the assemblies in place in an alignment fixture At step 222, after the planar circulator assembly 10 is laminated, RF vias for the receive port RF via $\mathbf{90}_{RX}$, the antenna port RF via $\mathbf{90}_{A}$, and the transmit port RF via $\mathbf{90}_{TX}$ are drilled through the circulator assembly 10.

At step 223, after the planar circulator assembly 10 is laminated, mode suppression posts for the receive port RF via $\mathbf{90}_{RX}$, the antenna port RF via $\mathbf{90}_{A}$, and the transmit port RF via $\mathbf{90}_{TX}$ are drilled through the circulator assembly 10. At step 224 the RF vias 90 and mode suppression posts, which were drilled out in steps 222, 223, are plated using known techniques. In one embodiment the vias 90 are plated with copper.

At step 226, circuits are imaged and etched on both external surfaces of the assembly the outside surfaces of the circulator assembly 10 assembly. The via stubs 94 are drilled out using a known counter drilling (also referred to as depth drilling) technique to remove the excess plating material so that the un-terminated plated via portions will not a conduct RF signal and act as reactive stubs, at step 228.

At step 230, the magnets 50 are individually or batch gaussed (i.e. magnetized) to provide a direct current (DC) magnetic field required to support the circulator action. By gaussing the magnets 50 to saturation after the bonding operation at step 220, the magnets 50 do not lose any of the required magnetic field strength due to the effects of the bonding temperatures. In one embodiment, the magnets 50 are gaussed by placing the planar circulator assembly 10 in the proper orientation between the poles of an electromagnet.

At step 232, the fabrication of the embedded planar circulator assembly 10 is complete. As described above, if the unit cells 54 are to be used as individual components, the circulator assembly 10 would be further processed to separate the unit cells (i.e. individual circulators) from the final assembly. To facilitate the production of individual components, the overall board layout would be optimized for ease of separation and to maximize the quantity of individual circulators produced. It will be appreciated by those of ordinary skill in the art that some of the above steps can occur in a different order to facilitate the manufacturing process.

In an alternative embodiment, either the transmit port or the receive port is terminated in a resistive load to provide an embedded planar isolator. In one embodiment, the resistive load is provided by resistors buried in the circulator PTFE board layers, for example, Ohmega-Ply® resistors, as is known in the art. The resistors are embedded in the circulator circuit board 42, etched and exposed on the circulator circuit 54 (FIG. 3) to terminate the receive port 72 or the transmit port 70. Ohmega-Ply® is a registered trademark of Ohmega Technologies, Inc. Configurations having buried resistors are used for example in applications where a low radar cross section (RCS) is required.

All publications and references cited herein are expressly incorporated herein by reference in their entirety.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims.

What is claimed is:

1. A planar circulator assembly comprising:

a dielectric substrate having a first surface and an opposing second surface;

a plurality of circulator circuits each having a first ferrite receiving pad disposed on the first surface and a second ferrite receiving pad disposed on the second surface;

a first sub-assembly board disposed on the first surface of the dielectric substrate having a plurality of first apertures;

a plurality of ferrite-magnet sub-assemblies, each ferrite-magnet sub-assembly disposed in a corresponding one of the first apertures and aligned and electromagnetically coupled with a corresponding one of the first ferrite receiving pads;

a second sub-assembly board disposed on the second surface of the dielectric substrate having a plurality of second apertures; and a plurality of ferrites, each ferrite disposed in a corresponding one of the second apertures and aligned and electromagnetically coupled with a corresponding one of the second ferrite receiving pads.

2. The circulator assembly of claim 1 wherein each of the plurality of ferrites further comprises a pole piece.

3. The circulator assembly of claim 2 wherein the pole piece is steel.

4. The circulator assembly of claim 1 further comprising:

a first ground plane disposed in the first sub-assembly board; and a second ground plane disposed in the second sub-assembly board.

5. The circulator assembly of claim 1 wherein each of the plurality of circulator circuits further comprises a first circuit portion disposed on the first surface and a second circuit portion disposed on the second surface.

6. The circulator assembly of claim 1 wherein:

the first ferrite receiving pad comprises a first plurality of interconnecting via connections;

the second ferrite receiving pad comprises a second plurality of interconnecting via connections; and the circulator assembly further comprises a plurality of interconnecting vias each having a first end coupled to a corresponding one of the first plurality of interconnecting via connections and a second end coupled to a corresponding one of the second plurality of interconnecting via connections.

7. The circulator assembly of claim 1 wherein each of the plurality of circulator circuits further comprises:

a first port coupled to the first and second ferrite receiving pads;

a second port coupled to the first and second ferrite receiving pads; and a third port coupled to the first and second ferrite receiving pads.

8. The circulator assembly of claim 7 wherein each of the first, second and third ports comprises:

a first portion disposed on the first surface of the dielectric substrate having a first RF port via connection;

a second portion disposed on the second surface of the dielectric substrate having a second RF port via connection; and an RF port via having a first end coupled to the first RF port via connection and a second end coupled to the second RF port via connection.

9. The circulator assembly of claim 8 wherein the RF port via extends to an outer surface of one of the first sub-assembly board and the second sub-assembly board.

10. The circulator assembly of claim 8 further comprising:

a first ground plane disposed in the first sub-assembly board;

a second ground plane disposed in the second sub-assembly board;

a first plurality mode suppression post connections disposed adjacent each a plurality of mode suppression posts disposed adjacent to each of the first, second and third ports and coupled to the first and second ground planes.

11. The circulator assembly of claim 8 wherein each of the plurality of circulator circuits further comprises a plurality of stripline transmission lines coupling each of the first, second and third ports to the first and second ferrite receiving pads.

12. The circulator assembly of claim 11 wherein each of the stripline transmission lines comprises:

a first stripline circuit portion disposed on the first surface having a first plurality of interconnecting via connections;

a second stripline circuit portion disposed on the second surface having a second plurality of interconnecting via connections; and a plurality of interconnecting vias each having a first end coupled to a corresponding one of the first plurality of interconnecting via connections and a second end coupled to a corresponding one of the second plurality of interconnecting via connections.

13. The circulator assembly of claim 7 wherein the first, second and third ports comprise an antenna port, a transmit port and a receive port respectively.

14. The circulator assembly of claim 7 wherein the first, second and third ports comprise an antenna port, an isolator port, and at least one of:

a transmit port; and a receive port.

15. The circulator assembly of claim 7 further comprising:

a first outer surface;

a second outer surface disposed opposite the first outer surface;

at least one first RF port via disposed in the first sub-assembly board, having a first end coupled to at least one of the first, second and third ports and a second end coupled to a connection disposed on the first outer surface of the circulator assembly; and at least one second RF port via disposed in the second sub-assembly board, having a first end coupled to at least one different one of the first, second and third ports and a second end coupled to a connection disposed on the second outer surface of the circulator assembly disposed opposite the first outer surface.

16. The circulator assembly of claim 15 wherein the at least one first RF port via and the at least one second RF port comprise copper plated vias.

17. The circulator assembly of claim 1 further comprising a plurality of interconnecting vias disposed between each of the first ferrite receiving pads and each of a corresponding second ferrite receiving pad, the interconnecting vias electromagnetically coupling each first ferrite receiving pad to the corresponding second ferrite receiving pad.

18. A method for fabricating an embedded planar circulator assembly comprising:

providing a circulator board having a first surface and an opposing second surface;

forming a plurality of circulator circuits on the circulator board, each circulator circuit having a ferrite receiving pad disposed on the first surface and a corresponding ferrite receiving pad on the second surface;

providing a plurality of ferrite-magnet sub-assemblies disposed in a first sub-assembly;

providing a plurality of ferrites disposed in a second sub-assembly; and bonding the circulator board between the first sub-assembly and the second sub-assembly such that the ferrite-magnet sub-assemblies are urged against a corresponding ferrite receiving pad disposed on the first surface of the circulator board and the ferrites are urged against the corresponding ferrite receiving pad on the second surface of the circulator board.

19. The method of claim 18 wherein forming a plurality of circulator circuits comprises:

forming circulator circuit portions on the first surface and the second surface, each of the circulator circuits portions comprising:

a first, second and third port portions, each port portion coupled to a corresponding ferrite receiving pad by a stripline circuit.

20. The method of claim 19 wherein forming a plurality of circulator circuits further comprises:

forming a first, second and third port by connecting the circulator circuit port portions on the first surface and the second surface using interconnecting vias; and connecting the stripline circuits on the first surface and the second surface by using interconnecting vias.

21. The method of claim 20 further comprising:

forming at least one first RF port vias disposed in the first sub-assembly board, each first RF via having a first end coupled to one of the first, second and third ports and a second end coupled to a connection disposed on a first outer surface of the circulator assembly; and forming at least one second RF vias disposed in the second sub-assembly board, each second RF via having a first end coupled to one of the first, second and third ports and a second end coupled to a connection disposed on a second outer surface of the circulator assembly disposed opposite the first outer surface.

22. The method of claim 21 further comprising plating the RF vias with copper.

23. The method of claim 22 counter drilling the RF vias to remove excess copper plating.

24. The method of claim 18 wherein bonding comprises adhesively bonding the circulator board between the first sub-assembly and the second sub-assembly using thermoplastic materials.

25. The method of claim 18 further comprising separating the plurality of circulator circuits into a corresponding plurality of individual unit cells.

* * * * *

UNITED STATES PATENT AND TRADEMARK OFFICE

CERTIFICATE OF CORRECTION

PATENT NO. : 6,611,180 B1 
DATED : August 26, 2003
INVENTOR(S) : Angelo Puzella et al.

It is certified that error appears in the above-identified patent and that said Letters Patent is hereby corrected as shown below:

Title page,
Item [57], ABSTRACT,
Line 5, delete "receiving pad; disposed" and replace with -- receiving pad disposed --.
Line 6, delete "surface a first" and replace with -- surface, a first --.

Column 1,
Line 47, delete "For example such" and replace with -- For example, such --.
Lines 52-53, delete "conventional systems the" and replace with -- conventional systems, the --.

Column 4,
Line 49, delete ", of course that" and replace with -- , of course, that --.

Column 5,
Line 7, delete "In a radar system the" and replace with -- in a radar system, the --.
Line 30, delete ", here for example steel" and replace with -- , here for example, steel --.
Line 38, delete "that that the" and replace with -- that the --.
Line 45, delete ", for example Rogers" and replace with -- , for example, Rogers --.
Line 49, delete "embodiment the" and replace with -- embodiment, the --.

Column 6,
Line 17, delete "tan δ" and replace with -- –tan δ --.

Column 7,
Line 17, delete "from a" and replace with -- forming a --.
Line 20, delete "In one embodiment the" and replace with -- In one embodiment, the --.
Line 31, delete "44 respectively" and replace with -- 44, respectively --.
Line 64, delete "90rx" and replace with -- $90_{rx}$ --.

Column 8,
Line 32, delete "96lower" and replace with -- 96 lower --.
Line 49, delete "cavities 46)" and replace with -- cavity 46) --.
Line 58, delete "sub-assembly 44 upper" and replace with -- sub-assembly 44, upper --.

UNITED STATES PATENT AND TRADEMARK OFFICE

CERTIFICATE OF CORRECTION

PATENT NO. : 6,611,180 B1
DATED : August 26, 2003
INVENTOR(S) : Angelo Puzella et al.

It is certified that error appears in the above-identified patent and that said Letters Patent is hereby corrected as shown below:

Column 9,
Line 17, delete “cavities 46” and replace with -- cavity 46 --.
Line 20, delete “cavities” and replace with -- cavity --.
Line 46, delete “assembly 59” and replace with -- assemblies 59 --.

Column 10,
Line 18, delete “they are may” and replace with -- they may --.
Line 44, delete “at step 224 the” and replace with -- at step 224, the --.
Line 50, delete “circulator assembly 10 assembly.” and replace with -- circulator assembly 10. --.

Column 11,
Line 20, delete “used for example” and replace with -- used, for example, --.
Line 27, delete “felt therefore that” and replace with -- felt, therefore, that --.

Column 12,
Line 64, delete “port respectively” and replace with -- port, respectively --.

Signed and Sealed this

Eleventh Day of November, 2003

JAMES E. ROGAN
*Director of the United States Patent and Trademark Office*